US006880465B2

(12) United States Patent
Badger et al.

(10) Patent No.: US 6,880,465 B2
(45) Date of Patent: Apr. 19, 2005

(54) ACCUMULATED DETONATING CORD EXPLOSIVE CHARGE AND METHOD OF MAKING AND OF USE OF THE SAME

(75) Inventors: Farrell G. Badger, Mapleton, UT (US); Robert A. Lee, Tariffville, CT (US); Lyman G. Bahr, Payson, UT (US); Daniel P. Sutula, Jr., Farmington, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 10/315,455

(22) Filed: Dec. 10, 2002

(65) Prior Publication Data

US 2004/0025734 A1 Feb. 12, 2004

Related U.S. Application Data

(62) Division of application No. 09/488,225, filed on Jan. 19, 2000, now Pat. No. 6,508,176.

(60) Provisional application No. 60/116,493, filed on Jan. 20, 1999.

(51) Int. Cl.[7] ..... C06C 5/02

(52) U.S. Cl. ..... 102/275.7; 102/275.8; 102/275.9; 102/275.12; 102/287

(58) Field of Search ..... 102/275.7, 275.8, 102/275.9, 275.12, 287, 289, 291

(56) References Cited

U.S. PATENT DOCUMENTS

| | | | | |
|---|---|---|---|---|
| 100,884 A | 3/1870 | Gomez | | |
| 954,595 A | 4/1910 | Spery | | |
| 960,867 A | 6/1910 | Fahy | | |
| 3,244,099 A | 4/1966 | Lang et al. | ..... | 102/20 |
| 3,276,373 A | 10/1966 | Lyons | ..... | 102/27 |
| 3,289,583 A | 12/1966 | Silverman | ..... | 102/20 |

(Continued)

FOREIGN PATENT DOCUMENTS

| | | | | |
|---|---|---|---|---|
| FR | 2 506 449 | 11/1982 | ..... | F42C/19/08 |

*Primary Examiner*—Michael J. Carone
*Assistant Examiner*—Jame S. Bergin
(74) *Attorney, Agent, or Firm*—Cantor Colburn LLP

(57) ABSTRACT

An initiator (14*c*) for a secondary explosive receptor charge is provided by forming a length of detonating cord (14) into a helical coil containing a plurality of windings with a cut-off barrier provided by, e.g., a separating rib (46) between adjacent windings. The adjacent windings may be not more than about 0.5 inch (12.7 mm) apart. The detonating cord (14) may be wound about a spindle (16) which may optionally provide the separating rib (46). The coil may be a tapered coil which may define a taper angle of e.g., from about 2 to 4 degrees. Alternatively, the coil may be a cylindrical coil, or the cord may be configured in a planar spiral. Optionally, the detonating cord in the helical coil may have a core of explosive material with a loading of less than 15 grains per foot of the cord, e.g., less than 12 grains per foot of the cord, or a loading in the range of from 8 to 12 grains per foot of the cord. The coil may consume about six inches of the cord. Conversely, the detonating cord in the spiral may have a core of explosive material with a loading of at least 2.5 grains per foot, optionally at least 15 grains per foot of the cord.

14 Claims, 5 Drawing Sheets

U.S. PATENT DOCUMENTS

| | | | | | |
|---|---|---|---|---|---|
| 3,437,037 | A | | 4/1969 | Newman | 102/24 |
| 3,598,052 | A | * | 8/1971 | Schwartz et al. | 102/431 |
| 3,687,074 | A | * | 8/1972 | Andrews et al. | 116/137 R |
| 3,698,316 | A | | 10/1972 | Evans | 102/27 |
| 3,729,060 | A | | 4/1973 | Murray | 181/0.5 XC |
| 3,832,949 | A | | 9/1974 | Delgendre et al. | 102/1 R |
| 3,886,008 | A | * | 5/1975 | Cook | 149/41 |
| 3,908,549 | A | | 9/1975 | Turner | 102/27 R |
| 4,111,126 | A | * | 9/1978 | Thomanek | 102/476 |
| 4,187,780 | A | | 2/1980 | Petruccelli | 102/28 R |
| 4,232,606 | A | | 11/1980 | Yunan | 102/27 R |
| 4,284,006 | A | | 8/1981 | Davis | 102/317 |
| 4,426,933 | A | | 1/1984 | Yunan | 102/275.3 |
| 4,527,482 | A | | 7/1985 | Hynes | 102/331 |
| 4,615,752 | A | | 10/1986 | Miller | 149/108.8 |
| 4,667,599 | A | | 5/1987 | Brand | 102/275.4 |
| 4,714,018 | A | | 12/1987 | Löfgren | 102/275.7 |
| 5,125,473 | A | | 6/1992 | Sakamoto et al. | 181/116 |
| 5,192,828 | A | | 3/1993 | Austin et al. | 102/275.12 |
| 5,299,500 | A | | 4/1994 | Lindquist et al. | 102/275.12 |
| 5,614,693 | A | | 3/1997 | Welch | 102/318 |
| 5,714,712 | A | | 2/1998 | Ewick et al. | 102/311 |
| 5,780,763 | A | | 7/1998 | Schimmel et al. | 102/302 |
| 5,780,764 | A | | 7/1998 | Welch et al. | 102/318 |
| 6,006,671 | A | | 12/1999 | Yunan | 102/275.11 |

* cited by examiner

ACCUMULATED DETONATING CORD EXPLOSIVE CHARGE AND METHOD OF MAKING AND OF USE OF THE SAME

CROSS REFERENCE TO RELATED APPLICATIONS

This application is a division of U.S. patent application Ser. No. 09/488,225, filed Jan. 19, 2000, now U.S. Pat. No. 6,508,176 in the name of Farrell G. Badger et al and entitled "ACCUMULATED DETONATING CORD EXPLOSIVE CHARGE AND METHOD OF MAKING AND USE OF THE SAME", which claims the benefit of U.S. provisional application Ser. No. 60/116,493, filed Jan. 20, 1999, entitled "LOW-ENERGY DETONATING CORD ACCUMULATOR AND METHOD FOR INITIATION OF EXPLOSIVE CHARGES".

BACKGROUND OF THE INVENTION

1. Field of the Invention

The present invention relates to a device and method for forming an explosive charge and explosive from detonating cord and for initiation of receptors such as signal transmission lines and explosive charges.

2. Related Art

In prior art explosive initiation systems it is known to lower into a borehole a cast booster explosive having a cap well into which has been inserted an electric detonator. The electric detonator is fitted with electrically conductive legwires which are long enough to extend from within the borehole to the surface of the blasting site. The long legwires of such systems are expensive and subject to breakage in lowering and positioning the cast boosters in the borehole. In addition, the assembly of the primary explosive of the detonators with the secondary explosive cast boosters in the borehole increases the handling risks relative to boosters that do not contain primary explosive materials.

It is also known in the art to utilize, in lieu of the electrically conductive legwires, downline high-energy detonating cords to initiate the cast booster explosives. Such highenergy detonating cords typically have explosive core loads from about 3.8 to 10.6 grams per linear meter of cord ("g/m"), equivalent to 18 to 50 grains per linear foot of cord ("gr/ft") of pentaerythritol tetranitrate ("PETN") or equivalent amounts, in terms of explosive power, of other secondary explosive. Such high-energy detonating cord is used in the mining industry to initiate the cast booster explosives without the intervention of a detonator between the downline detonating cord and the cast booster. In mining operations, however, the high-energy detonating cord tends to disrupt the bulk (main) explosive charge and is expensive as compared to low-energy detonating cord. In seismic blasting operations, the use of high-energy detonating cord is not satisfactory because the high-energy detonating cord releases significant energy along paths remote from the points at which energy is released by the cast booster charges, and therefore renders seismic data less precise.

It is also known to utilize low-energy detonating cord to directly (without an intervening detonator or the like) initiate an explosive charge which contains a sensitive explosive against which the low-energy detonating cord is placed and which is in contact or close proximity with an explosive charge comprising a less sensitive, e.g., secondary, explosive. This arrangement requires utilizing a more sensitive explosive in conjunction with a less sensitive one, thereby increasing the risk of accidental initiation of the explosive charge.

U.S. Pat. No. 5,714,712, issued to Ewick et al, discloses an explosive initiation system which ameliorates many of the problems discussed above by directly connecting a low-energy detonating cord to the booster explosive. The system of U.S. Pat. No. 5,714,712 is especially useful for initiating a plurality of substantially simultaneous seismic detonations and includes an electric trunkline circuit disposed on the surface of a firing site containing boreholes, within which booster charges are disposed. The booster charges 30*a*–30*d* (FIG. 1 of U.S. Pat. No. 5,714,712) are connected without intervening detonators to the downhole ends of equal-sized lengths of low-energy detonating cord 28*a*–28*d*, the surface ends of which are connected to electric detonators contained within connector blocks 24*a*–24*d*, which are connected in series in the firing circuit.

FIG. 2 of U.S. Pat. No. 5,714,712 illustrates one way of connecting the downhole end of the low-energy detonating cord 28*a* to a booster charge 30*a* by embedding a knotted end of the low-energy detonating cord within the cast booster charge 30*a*. The knot renders the cord in a non-cylindrical, non-planar configuration. The embodiment of FIG. 2 requires factory manufacture to cast the explosive around the knotted low-energy detonating cord and precludes onsite cutting of the detonating cord to selected lengths from a spool. In the embodiment illustrated in FIGS. 2A and 2B, a cord retaining member 41 is used to retain a double length of the low-energy detonating cord within a cord well 39 formed in the top portion 32*x* of the cast booster charge 30*x*. The embodiment of FIGS. 2A and 2B may be assembled in the field but can expose only a limited amount of low-energy detonating cord to the booster explosive.

As used herein, the term "detonating cord" has its usual meaning of flexible, coilable cord having a core of high explosive, the core being a secondary explosive, usually PETN. The term "low-energy detonating cord" or "LEDC", is conventionally used to mean detonating cord which will not reliably initiate itself when placed in contact with itself by coiling or crossing lengths of the cord, and which will not, when in an ungathered configuration, reliably directly initiate a less sensitive or secondary explosive receptor charge, e.g., those that comprise secondary explosive materials (e.g., Pentolite mixtures of PETN and trinitrotoluene ("TNT")) to the substantial exclusion of primary explosive materials. Such ungathered configurations include, e.g., simple surface-to-surface contact between an uncoiled LEDC and a receptor charge and the insertion of the end of a substantially straight length of LEDC into a bore in the body of a receptor charge. For this reason, LEDC is typically used to initiate a more sensitive, high energy amplifying device such as a detonator which is sensitive to the LEDC (usually by virtue of containing a primary explosive material) and which generates an output signal sufficient to initiate the less sensitive secondary explosive receptor charge.

SUMMARY OF THE INVENTION

The present invention provides a method for forming an explosive charge, the method comprising forming a length of detonating cord into a substantially helical coil comprising a plurality of windings with a cut-off barrier between adjacent windings.

According to various aspects of the invention, the method may comprise spacing adjacent windings not more than about 0.5 inch (12.7 mm) from each other, e.g., about 0.13 inch (3.3 mm), the method may comprise wrapping the detonating cord about a spindle which may optionally comprise the cut-off barrier, the method may comprise forming the length of detonating cord in a tapered coil which may optionally define a taper angle of from about 2 to 4 degrees; or the method may comprise forming the length of detonating cord in a cylindrical coil.

According to another aspect of the invention, the detonating cord may have a core of explosive material with a loading of less than 15 grains per foot of the cord. For example, the detonating cord may have a core of explosive material with a loading of 12 grains or less per foot of the cord, or a loading in the range of from 8 to 12 grains per foot of the cord.

According to still another embodiment of the invention, the coil may comprise about six inches of detonating cord.

This invention also provides a method for forming an explosive charge comprising forming a length of detonating cord in a substantially planar spiral comprising a plurality of windings. Optionally, the detonating cord in the spiral may have a core of explosive material with a loading of at least 2.5 grains per foot of the cord.

The invention also provides an explosive charge comprising a length of detonating cord as described above disposed in a substantially helical coil or planar spiral configuration by the foregoing method or by any other means.

According to one aspect of this invention, the initiator may comprise a spindle about which the coil is disposed. The spindle may optionally be configured to support a substantially helical coil that defines a taper angle of from about 2 to 4 degrees. The spindle may optionally comprise the cut-off barrier.

Alternatively, the spindle may be configured to support a substantially planar coil. In such an embodiment, the detonating cord may have a core of explosive material with a loading of at least 2.5 grains per foot of detonating cord, optionally at least 15 grains per foot. The spindle may comprise a pair of plates between which the substantially planar spiral is disposed.

This invention also relates to a method for initiating an explosive receptor charge. The method comprises inserting into the explosive charge an initiator comprising a length of detonating cord disposed in a helical or spiral coil as described above, and initiating the detonating cord. Optionally, the detonating cord may comprise low-energy detonating cord and optionally, the receptor charge and the initiator may be substantially free of primary explosive materials.

This invention also relates to an accumulator spindle comprising a spindle body that carries a spiral cut-off barrier, the barrier defining a helical groove on the spindle body; and an anchor aperture. The spindle may also comprise a cleat projection. The helical groove may define a taper angle of from about 2 to 4 degrees. Also optionally, the groove may have two ends and the anchor aperture may be at one end of the groove and the cleat projection may be at the other end of the groove.

Alternatively, the present invention may provide an accumulator spindle comprising a spindle body comprising two spaced-apart parallel plates; an anchor aperture; and a cleat projection.

This invention further pertains to a receptor-initiator assembly comprising a receptor charge comprising a body of explosive material having an initiator well therein; and a helical or planar coil of detonating cord disposed in the initiator well. There may be a receiving portion associated with the body of explosive material, the helical coil may be mounted on a spindle and the spindle may be secured to the receiving portion. For example, the spindle may be secured to the receiving portion by a detent and groove engagement between them. Optionally, the helical coil and the initiator well each define a taper angle of from about 2 to 4 degrees.

In any of the foregoing embodiments, one or both of the initiator and the receptor charge may be substantially free of primary explosive materials.

As used herein, the terms "large" and "small" when used to refer to detonating cord, including LEDC, refer to the relative loading of explosive material in the core of the cord, smaller cord having less explosive material per linear unit and, accordingly, a less powerful output than a larger cord.

DETAILED DESCRIPTION OF THE INVENTION AND PREFERRED EMBODIMENTS THEREOF

Figure 1:
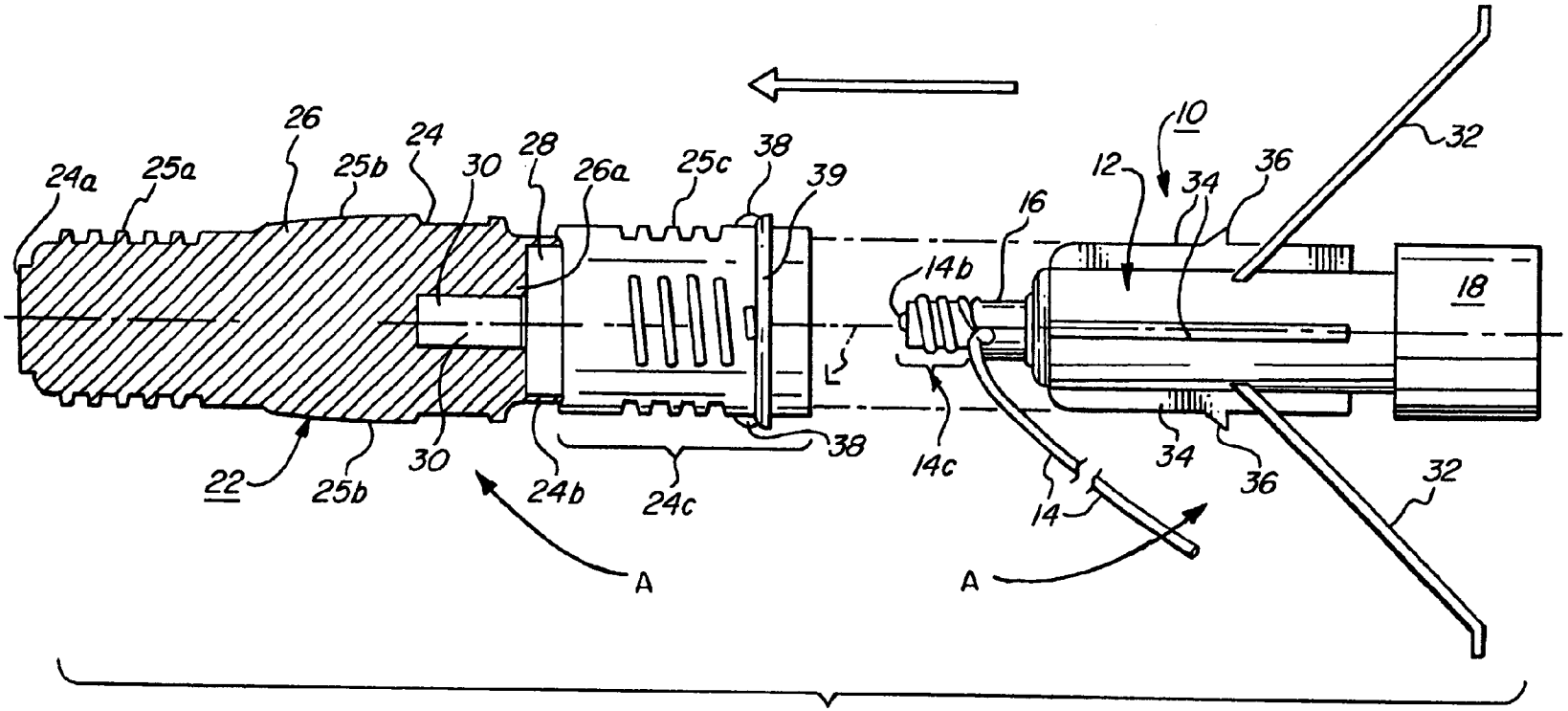
FIG. 1 is an exploded view of an assembly of a cast booster charge and an LEDC initiator in accordance with one embodiment of the present invention.

Generally, the present invention provides enhanced reliability in the use of detonating cord, including low-energy detonating cord, as an explosive charge for various functions in which a straight, linearly configured cord would not provide adequate output energy. One such use is for the direct initiation of receptor charges such as a signal transmission line (e.g., another detonating cord) or main explosive charges (e.g., "booster" charges used in boreholes at blasting sites) that are comprised of relatively insensitive explosive materials, e.g., secondary, explosive materials. The present invention provides initiator charges for such receptor charges produced by a method comprising configuring or "accumulating" the detonating cord into a coil comprising a plurality of windings as to increase the amount of explosive material of the cord in a booster charge or other receptor device relative to a linear configuration of the cord, and further provides devices on which the detonating cord may be so configured. The device comprises an accumulator spindle for supporting the detonating cord in a helical or planar spiral configuration. As a result of the coiled configurations disclosed herein, the amount of energy released by the detonating cord in a given booster charge or other receptor device is increased relative to substantially straight detonating cord passing therethrough and the reliability of the detonating cord in directly initiating receptor charges, especially those consisting essentially of less sensitive or secondary explosive materials, is greatly enhanced.

Consequently, where prior art practice would call for detonating cord of a particular core load for the reliable initiation of, e.g., a booster charge, the present invention permits the use of detonating cord of a lower core load with equivalent reliability. For example, the prior art practice called for 50 grain PETN per foot detonating cord to initiate a 50/50 Pentolite (50% PETN, 50% TNT) booster charge, the present invention enables the use of detonating cord having a core load of 25 grains per foot. Similarly, where the prior art calls for 25 grain per foot to initiate a 60/40 Pentolite booster, the present invention enables the use of LEDC having a core load in the range of from about 6 to 10 grains per foot. As will be appreciated by one of ordinary skill in the art, the 60/40 Pentolite is more sensitive to initiation than 50/50 Pentolite and so permits the use of detonating cord of smaller core load than is needed for 50/50 Pentolite.

It has been found in testing that some coiled detonating cord will cross or self-initiate, between windings, i.e., that the output of one winding will reliably initiate an adjacent winding. This has been found to occur with core loads of more than 12 grains per foot PETN. However, when LEDC has only about 12 grains per foot or less and there is contact between adjacent windings of the cord, or when coil windings are too close to one another, one portion of the cord can be broken or "cut off", i.e., severed or damaged, by another that has been initiated, without initiating the cut-off portion. As a result, the cut-off portion does not initiate when the initiation reaction advances to it from the portion that caused the cut-off. The full potential output of the LEDC coil is therefore not released. If the windings are separated sufficiently to avoid cut-off, however, the output energy released by the LEDC might not be sufficiently concentrated to reliably initiate a secondary explosive receptor charge. One aspect of the present invention pertains to forming a coil of LEDC having a core load of 12 gr/ft or less in which the windings are sufficiently close together to initiate a receptor device such as a 60/40 Pentolite booster and preventing cut-off by disposing a cut-off barrier between adjacent windings of the coil. The cut-off barrier protects uninitiated windings from the output of the initiated windings and thus preserves the integrity of the coil as the initiation signal proceeds through it. The coil may or may not have a precisely defined configuration, i.e., the helix need not have a uniform pitch, helix angle or radius, e.g., the windings may vary in spacing from each other. Accordingly, the coil is referred to herein as a substantially helical coil. A variety of spindle configurations as described elsewhere herein may be employed to support such a coil.

One method of the present invention for directly initiating a less sensitive or secondary explosive with LEDC comprises coiling the donor LEDC so that multiple turns of the LEDC are brought into close proximity to each other, and placing the coiled LEDC in contact with, or in close proximity to, a receptor device such as a signal transmission means or an explosive charge, to initiate the receptor device. The method preferably also provides for confining the configured body of LEDC to enhance the focusing of its explosive energy on the target receptor device. While the present invention was developed for use with LEDC, it has broader applicability and so may optionally be practiced using standard detonating cord as well.

The present invention makes feasible the use of detonating cord that contains explosive in an amount less than about 5.3 grams per linear meter of cord ("g/m"), which is equivalent to 25 grains per linear foot of cord ("gr/ft") of PETN (or an equivalent material), as a coiled explosive charge as described herein. For example, a preferred LEDC, especially for use with 60/40 Pentolite (comprising 60% PETN and 40% TNT (trinitrotoluene)) booster charges, contains not more than about 2.55 g/m (12 gr/ft) of PETN, e.g., from about 1.7 to 2.55 g/m (8 to 12 gr/ft) of PETN, or the equivalent in explosive force of some other suitable explosive. In one embodiment, the LEDC may contain a loading of 10 grains per foot. By utilizing the teachings of the present invention, such LEDC, when appropriately arranged into a configured body of LEDC as described herein, will reliably initiate secondary or other less sensitive explosives without the necessity of intermediate means, such as primary explosives, for amplifying the LEDC output. The invention, however, may optionally be used for the initiation of receptor charges that contain primary explosive materials. The invention is not limited to the preferred embodiment and may be practiced with LEDC having a loading of 10 gr/ft, and loadings of less than 8 grains per foot, e.g., the invention has been practiced with LEDC having loadings of 7, 6 and 4½ gr/ft and may be practiced using still smaller LEDC.

By enabling the use of smaller (lower energy) detonating cord than was previously needed for the reliable initiation of a particular receptor device e.g., of a particular booster charge, the present invention provides an improvement to the safety and reliability of the blasting operation. Safety is enhanced because smaller detonating cord poses less of a risk to users and reliability is enhanced because the smaller detonating cord causes less disruption to the blast site prior to the initiation of the receptor charge. This is particularly advantageous with regard to the use of a detonating cord downline used to initiate a booster charge for bore hole blasting because excessively powerful detonating cord may disrupt the column of bore hole explosive (typically ANFO). Using a smaller detonating cord to initiate the booster charge reduces the likelihood that such disruption will occur.

In addition, the use of smaller detonating cord is advantageous in seismology because seismic measurements are taken from the explosion of a booster charge implanted in the earth. The detonating cord employed to initiate the booster charge creates some seismic vibrations that precede and interfere as "noise" in the seismic signals derived from the initiation of the booster charge. Using a smaller detonating cord reduces the seismic noise generated when the booster charge is initiated and thus leads to easier and more accurate seismology.

FIG. 1 shows an exploded view of a receptor-initiator charge assembly A in accordance with one embodiment of the present invention useful in mining operations. Assembly A comprises a receptor charge 22 and an initiator apparatus 10 comprising an accumulator spindle 16 about which a low-energy detonating cord is coiled in accordance with one configuration of the present invention. The initiator apparatus 10 comprises a hollow body 12 having an accumulator spindle 16 at one end thereof and a coupling cylinder 18 at the other end thereof. The body 12 is generally cylindrical in form and may be composed of any suitably strong and durable material such as a synthetic organic polymer (plastic). Body 12 of initiator apparatus 10 also includes a pair of rearwardly diverging anchoring fins 32, longitudinally extending strengthening ribs 34 and locking tabs 36. Coupling cylinder 18 is of hollow, cup-like construction for receiving, e.g., an extension rod, used to push the assembly into place within a borehole, as described below.

The anchoring fins 32 serve to contact, at their distal ends, the wall of a borehole to hold Assembly A in place in a borehole, and to prevent reverse movement (withdrawal) of Assembly A as it is urged into a borehole (in the direction of the unnumbered arrow in FIG. 1) by an extension rod (not shown) received within the coupling cylinder 18.

Receptor charge 22 comprises a shell 24 within which the body of explosive charge 26 is disposed. Explosive charge 26 substantially fills shell 24 from its front end 24*a* to its reduced diameter portion 24*b*. ("Front" and "rear" as used with respect to receptor charge 22 and initiator apparatus 10 refer to the direction of movement of Assembly A, indicated by the unnumbered arrow in FIG. 1, through a borehole for positioning therein.) Explosive charge 26 has formed therein an initiator well 30. If desired, explosive charge 26 may also have one or more conventional capwells (not shown) formed therein and opening to surface 26*a*. The inclusion of such conventional capwells provides a "universal" booster charge as it enables receptor charge 22 to be used either with a conventional detonator cap system or with the direct LEDC system of the present invention. Explosive charge 26 may comprise any suitable secondary explosive such as a mixture of PETN and trinitrotoluene ("TNT") (commonly referred to as "Pentolite"), suitable for initiating an industrial borehole explosive such as ANFO (ammonium nitrate/fuel oil). In order to enhance the reliability of initiation of receptor charge 22, a more sensitive secondary explosive or a primary explosive such as lead azide may optionally be employed, at least in the vicinity of initiator well 30. The shell 24 includes strengthening ribs 25*a*, 25*b*, 25*c* and locking slots 38 adjacent collar 39 and may be made of any suitable plastic material such as medium- or high-concentration polyethylene. Shell 24 has a hollow receiving portion 24*c* which is carried with receptor charge 22 and which is dimensioned and configured to receive therein that portion of body 12 between locking tabs 36 and accumulator spindle 16, as more fully described below.

A length of LEDC 14 is selected to be long enough to extend from the selected position of Assembly A within a borehole to an initiation device to which LEDC 14 may be connected in any conventional manner. Such initiation devices are well known in the art. One example of such a connection is shown in U.S. Pat. No. 5,714,712, the disclosure of which is hereby incorporated herein by reference for background information. Naturally, LEDC 14 could be connected to any suitable firing circuit or system, electric or non-electric, or on the surface or within the borehole. The LEDC 14 contains a solid core of explosive such as PETN or a mixture of PETN and TNT, contained within a flexible sheath or jacket of a suitable waterproofing and protective material, such as a plastic, which optionally may be reinforced with fibers.

Figure 2:
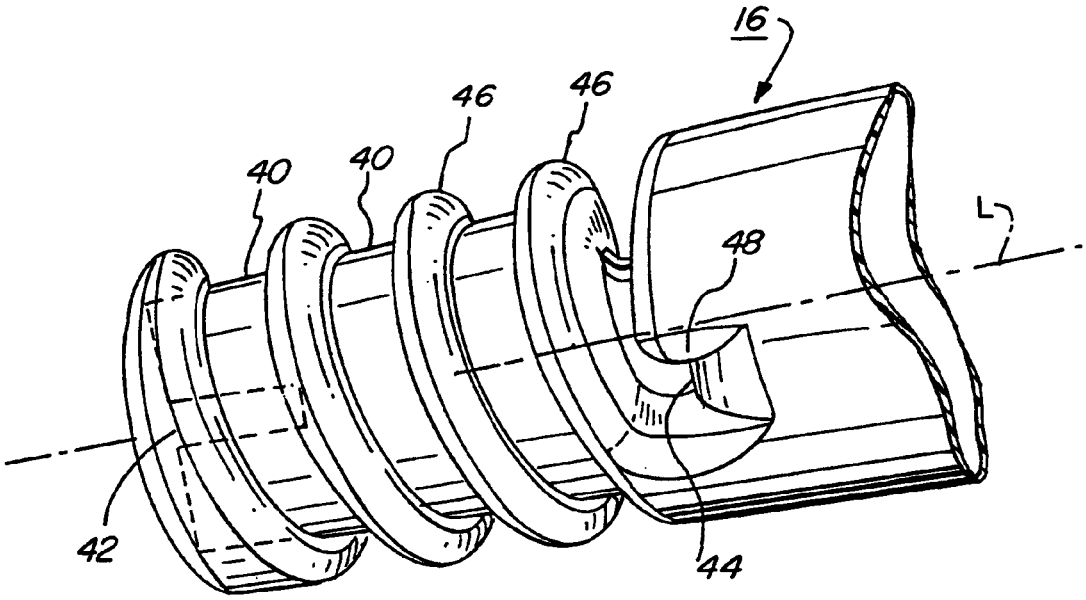
FIG. 2 is a partial, perspective view of the accumulator shown in FIG. 1.

The accumulator spindle 16, better seen in FIG. 2, functions to provide a support for coiling a length of LEDC 14 into a helical coil to form an initiator 14*c* comprising about four wraps of the cord. In such a configuration, the core mass of LEDC 14 is accumulated into the space about accumulator spindle 16 so that the explosive force of LEDC 14 is correspondingly concentrated or focused in contact with the explosive charge 26 surrounding initiator well 30, as described below. Accumulator spindle 16 is cylindrical in shape so that the coil of LEDC is cylindrical, i.e., it conforms to a uniform radius. The accumulator spindle 16 may be composed of any suitably strong and durable material such as a medium- or high-concentration polyethylene and comprises a helical groove 40 and an axial aperture 42. The helical groove 40 extends between the axial aperture 42 and a relief portion 44 of the accumulator spindle 16 and is bounded by a helical separating rib 46 that stands between adjacent windings of the helical groove. Aperture 42 is sized to receive and retain the end 14*b* of LEDC 14, thereby holding it in place while coiling a length of the LEDC 14 (FIG. 1) into the helical groove 40, thus forming a helical coil with the rib 46 serving as a cut-off barrier between adjacent windings. An optional cleat projection 48 (FIG. 2) is disposed opposite from aperture 42 along groove 40, adjacent to the relief portion 44. Cleat projection 48 cooperates therewith to clamp the LEDC 14 to the accumulator spindle 16 so that the coiled LEDC 14 may not be easily unwrapped from the accumulator spindle 16, as best seen in FIG. 1. This prevents unraveling of initiator 14*c* and retains it in the desired configured body shape on the accumulator. Strong retention of the LEDC 14 by the accumulator spindle 16 is also particularly advantageous in the event the initiator apparatus 10 is lowered into a borehole by means of the low-energy detonating cord 14 only.

The coiled configuration provides an increased concentration of explosive material in a given volume of space near or within a receptor device as compared to a straight length of LEDC. Without wishing to be bound by any particular theory, it is believed that by placing turns or windings of LEDC 14 (FIG. 1) in close proximity to each other to form initiator 14*c*, initiation of the LEDC will generate crossing and mutually reinforcing explosive shock waves which enhance energy input into the receptor charge, i.e., into the secondary explosive charge 26, or into a signal transmission detonating cord or other receptor device. Separating rib 46 provides a cut-off barrier between adjacent turns of the low-energy detonating cord 14 to prevent cut-off of one winding by the initiation of an adjacent winding. In this way, rib 46 helps assure that the entire coil of LEDC will initiate and the full energetic output of the coil will be delivered to the receptor charge. It will be understood that the separating rib 46 of accumulator spindle 16 may be omitted, or reduced in size for use with detonating cord containing relatively high core loadings, for which cut-off is not a problem. In such case, shallow grooves 40 may be employed to simply guide the location of each turn of the coiled detonating cord without preventing coil-to-coil abutting contact.

Accumulator spindle 16 may be made integral with body 12 or may be a separate piece which is designed to be attached to body 12 by any suitable means.

It has been found that when using low-energy detonating cord having a cord loading of 1.702 to 2.55 grams of PETN per meter of cord length (about 8 to 12 grains per foot), three to four turns of the LEDC 14 about the accumulator spindle 16, having a generally cylindrical configuration with a cross-sectional diameter of approximately ⅝ inch (1.59 cm) and separated by a cut-off barrier having a thickness of 0.13 inches (3.3 mm), will produce an initiator 14*c* which will reliably initiate a secondary explosive receptor charge such as a charge of Pentolite. This particular configuration results in a wrapping of a linear length of cord of approximately 6 inches (15.24 cm) about the accumulator spindle 16. A cut-off barrier of 0.13 inches (3.3 mm) was found to be suitable to prevent cut-off in LEDC having a core loading of 12 grains per foot. A smaller cut-off barrier would suffice for smaller LEDC but possibly not for the 12 gr/ft or larger LEDC. Since the cut-off barrier that prevents cut-off for larger cords will also prevent cut-off in smaller cords, efficiency is served by producing a spindle with the 0.13 inch cut-off barrier because this can serve to prevent cut-off for the largest LEDC for which cut-off is a concern and for many smaller LEDCs as well. Generally, four windings of LEDC having a PETN core loading of about 4½ grains per foot or more will provide sufficient output to reliably initiate a 60/40 Pentolite booster; three wraps of 6 gr/ft LEDC has been found to be adequate and 2 windings of 8 gr/ft LEDC has been found to be adequate for 60/40 Pentolite. It will be appreciated that LEDC with PETN loadings lower than 4½ gr/ft could be used provided the lower loading is offset as needed with more windings in the coil.

After LEDC 14 is wrapped about the grooves of accumulator spindle 16 as described above, receptor charge 22 is coupled with initiator apparatus 10 to provide Assembly A by inserting initiator apparatus 10 into receiving portion 24*c* of shell 24 until accumulator spindle 16, with initiator 14*c* coiled thereabout, is received within initiator well 30 of explosive charge 26. At that point, locking tabs 36 on body 12 of initiator apparatus 10 will engage, e.g., snap into, locking slots 38 formed adjacent to collar 39 in receiving portion 24*c* of shell 24. LEDC 14 passes through the annular space between the exterior of body 12 and the interior of receiving portion 24*c* of shell 24. The annular spacing is maintained by the ribs 34 which space the central or core portion of body 12 away from the inside wall of receiving portion 24*c*. LEDC 14 may extend from the resulting Assembly A of receptor charge 22 through the length of the borehole and to the surface of the blast site with a length on the surface sufficient to facilitate connection to a firing system utilized to initiate the LEDC.

Assembly A may be used in a conventional fashion to initiate a borehole explosive charge as described in the above-mentioned U.S. Pat. No. 5,714,712. It will also be appreciated that initiator apparatus 10 may be employed for initiating another length of low-energy detonating cord or a length of detonating cord or a length of high energy detonating cord.

According to another embodiment of this invention, the accumulator spindle and detonating cord may also be formed in a diameter which is sufficiently large so as to be disposed about the charge itself. That is, one end of the explosive charge may be received within a hollow accumulator spindle which supports the coiled LEDC. Optionally, the LEDC may be disposed or the interior surface of a hollow accumulator spindle. The spindle may optionally have grooves and ridges thereon to retain the LEDC in a coiled configuration.

According to yet another embodiment of this invention, an initiator may comprise LEDC wrapped in multiple layers about the accumulator spindle, providing suitable spacing between the layers is accomplished or a barrier between them is provided, if needed, to prevent cut-off.

It will further be appreciated that an accumulator spindle may be formed in any of a variety of cross-sectional configurations, such as an oval, a polygon, etc., about which the helical coil of detonating cord and barrier therefore are disposed. The spindle need not be uniform in cross-sectional configuration. Another possible configuration is a flat pinwheel shape. A conical or similarly tapered configuration may also be advantageous where a shaped charge effect is desired. Also, the accumulator spindle may be used in conjunction with a metal liner disposed, for example, within initiator well 30 to function as a flyer plate for increased initiation capability.

Figure 3:
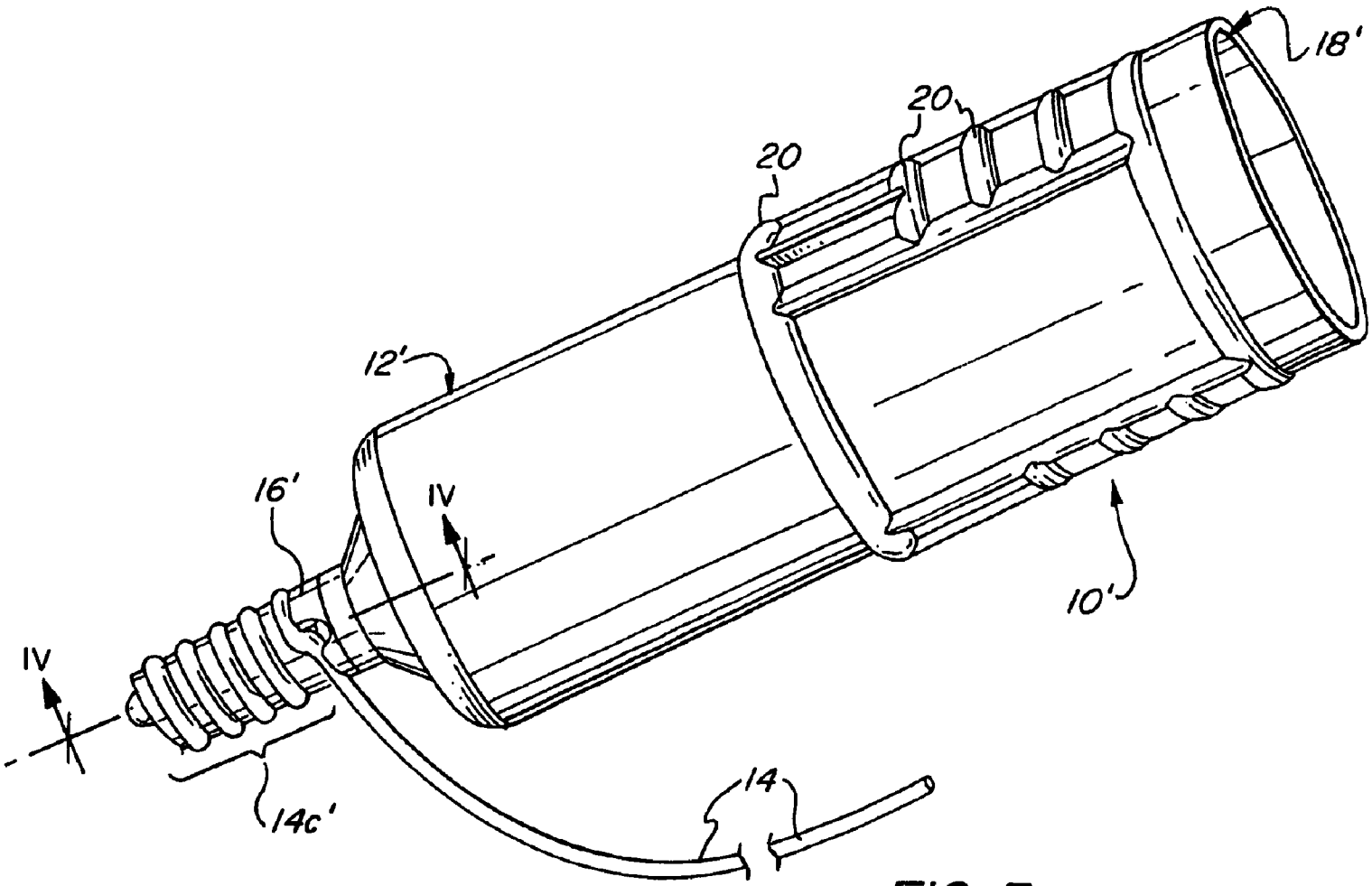
FIG. 3 is a perspective view of an LEDC initiator in accordance with a second embodiment of the present invention.
Figure 4:
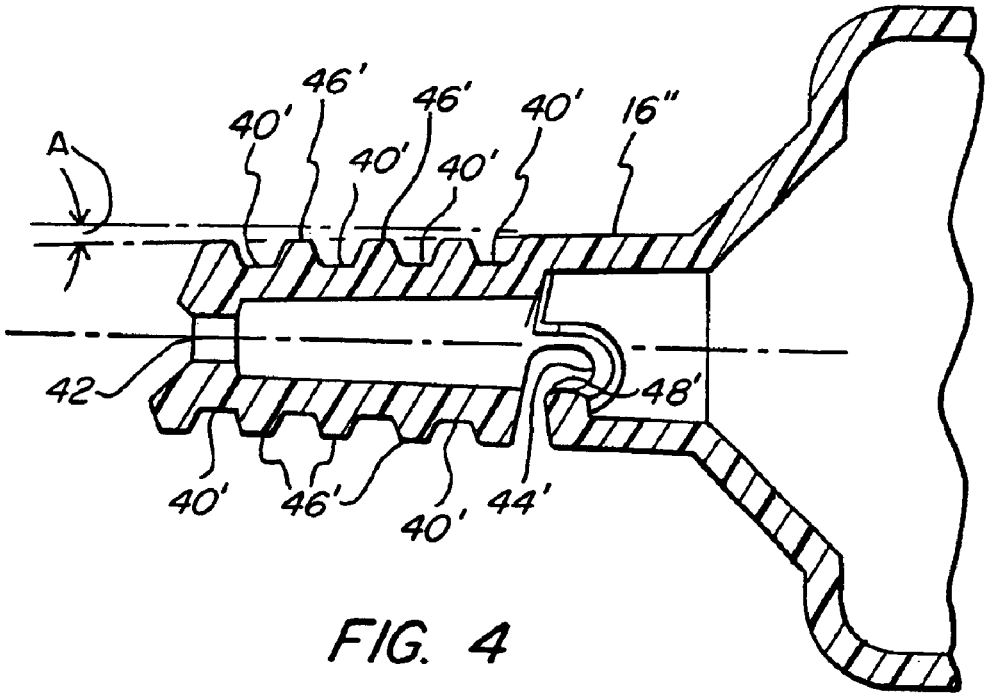
FIG. 4 is a cross-sectional view, enlarged relative to FIG. 3, taken along line IV—IV of FIG. 3.

FIG. 3 shows another embodiment of an LEDC initiator in accordance with the present invention, the accumulator spindle 16' of which is shown in enlarged, cross-sectional view in FIG. 4. In this embodiment, accumulator spindle 16' includes a taper having an angle A and is suited for the creation of a tapered coil LEDC initiator thereon. The tapered configuration facilitates insertion of the resulting initiator into an initiator well 30 while maintaining a snug fit between the explosive charge 26 and the coils of LEDC 14 about accumulator spindle 16'. The taper may also function to increase the interface pressure between the LEDC 14 and the explosive charge 26. In a particular embodiment angle A may be about 2 to 4 degrees, the diameter of accumulator spindle 16' diminishing from its proximal to its distal end, i.e., in the forward direction. In other embodiments, angle A may be larger than this; other suitable taper angles may be selected without undue experimentation. Body 12' is reinforced by a pattern of strengthening ribs 20, FIG. 3, and, at the end opposite to the end at which accumulator spindle 16' is attached, comprises a hollow, cup-like coupling cylinder 18' designed, like coupling cylinder 18 of the FIG. 1 embodiment, to receive, e.g., an extension rod, which is used to push the assembly of body 12' and a suitable booster charge coupled therewith into a borehole. Initiator apparatus 10' is inserted into a booster charge in a manner identical to that described with respect to the FIG. 1 embodiment with its coiled initiator 14*c*' received within an aperture well formed in the cast explosive of the booster charge. Locking tabs (not shown in FIG. 3) or other suitable means may be employed to lock LEDC initiator apparatus 10' in place within the booster charge associated therewith. Accumulator spindle 16" has a helically-extending groove 40' and separating ribs 46' as well as a relief portion 44' and a projection 48' which serve the same function as described above in connection with the embodiment of the accumulator spindle 16 of FIGS. 1 and 2.

A tapered configuration as shown in FIG. 3 is advantageous because it facilitates the insertion of the coiled initiator into the receptor charge and because it permits the coiled detonating cord to be pressed against the body of the receptor charge when it is inserted therein, thus improving the efficiency of energy transfer from the detonating cord to the receptor charge. The coupling mechanism that holds the spindle to the receptor charge can be configured to do so and maintain pressure between the coiled initiator and the receptor charge. A tapered spindle, like a non-tapered spindle, may have any of a variety of cross-sectional configurations, e.g., curved (round, oval, etc.), polygonal, etc.

Generally, to initiate receptor charge 22, an LEDC initiator such as coiled initiator 14*c* or 14*c*' is mated with the receptor charge with the coiled initiator inserted into a congruently-shaped initiator well such as initiator well 30, to provide intimate contact between the configured body of the coiled LEDC and the explosive defining the walls of the initiator well.

Wrapping a detonator cord about an accumulator spindle as described above facilitates the formation of the windings of the detonating cord and the disposition of the barrier between adjacent windings. It also provides a guide for the proper spacing of the windings and helps the user to achieve and maintain the coiled configurations without creating a "cross-over", i.e., a portion of detonating cord that overlays another. This is advantageous for LEDC because cross-overs can cause undesirable cut-offs.

Figure 5:
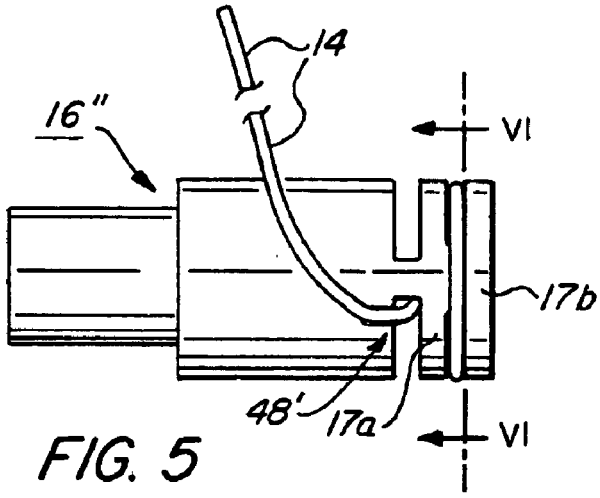
FIG. 5 is a schematic side elevation view of an accumulator in accordance with another embodiment of the present invention.
Figure 6:
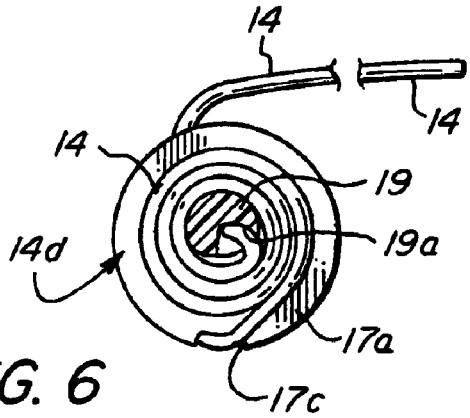
FIG. 6 is a cross-sectional view taken along line VI—VI of FIG. 5.

Referring now to FIGS. 5 and 6, there is shown yet another embodiment of an accumulator spindle 16" having a pair of spaced-apart circular plates 17*a*, 17*b* which are connected to each other by a central post or axle 19 (FIG. 6). Central post 19 thus is configured like an "axle" connecting tandem "wheels" comprised of plates 17*a*, 17*b*. As seen in FIG. 6, post 19 has a slot 19*a* within which an end (unnumbered) of detonating cord 14' may be inserted and retained. Slot 19*a* thus performs a function analogous to axial aperture 42 in the embodiment of FIG. 4. With an end of detonating cord 14' secured within slot 19*a*, detonating cord 14' is coiled in a substantially flat or planar spiral configuration between circular plates 17*a* and 17*b* to form a planar spiral initiator 14*d*. Lower plate 17*a* has a notch 17*c* that permits detonating cord 14' to pass by without exceeding the circular periphery of spindle 16" and so permits a receptor charge to have an initiator well configured to receive plates 17*a* and 17*b* without regard to the size or position of the detonating cord thereon. Optionally, spindle 16" may comprise a notch and cleat projection 48' to secure the free end of the detonating cord and to help prevent the coil between plates 17*a* and 17*b* from unwinding. In this arrangement, the detonating cord 14' must be chosen so that it is self-initiating winding to winding. Once initiated, the explosive energy generated by the configured body of coiled detonating cord 14' is forced axially outwardly by the confining action of circular plates 17*a*, 17*b* to provide a focused output of energy which will impinge upon a receptor which is arranged to encircle the space defined between the circular peripheries of circular plates 17*a*, 17*b*. For example, accumulator spindle 16" and initiator 14*d* may be inserted into a cast explosive having an initiator well similar to initiator well 30 of receptor charge 22 of the FIG. 1 embodiment. For purposes of this invention, any coil having a pitch of less than the diameter of the detonating cord, including zero pitch, is substantially flat or planar. Optionally, the pitch of a substantially planar spiral may be not more than one-half of the cord diameter.

Figure 7:
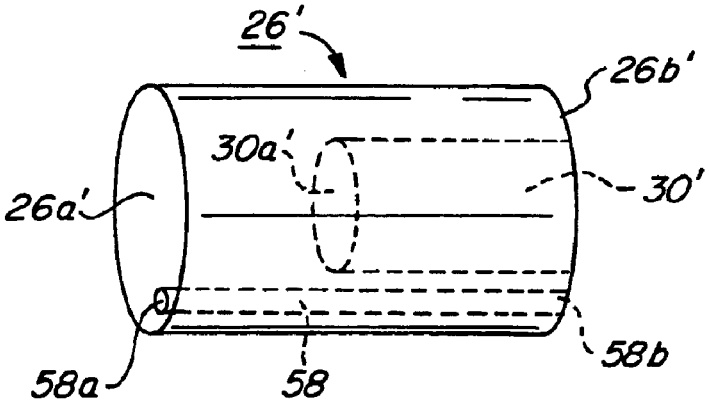
FIG. 7 is a schematic view of a cast booster explosive configured to receive an accumulator in accordance with the present invention disposed therein.

Referring now to FIG. 7, there is schematically shown a cast booster explosive receptor charge 26' of generally cylindrical configuration having a threading port 58 extending therethrough and open at the opposite ends 26*a*' and 26*b*' of explosive receptor charge 26'. An initiator well 30' is formed within receptor charge 26' and is open to end 26*b*' thereof. In this embodiment, one end of a length of detonating cord (not shown in FIG. 7) may be inserted into threading port 58 via opening 58*a* thereof and threaded therethrough to emerge via opening 58*b* at the other end of threading port 58. Threading port 58 will be dimensioned and configured relative to the detonating cord (not shown) so that the detonating cord fits slidably but snugly within threading port 58 in a linear configuration, in which its initiation does not release energy sufficient to initiate charge 26'. The detonating cord will be pulled through threading port 58 until a length of it emerges from opening 58*b*. The detonating cord is pulled until the emergent length is long enough to form a coiled initiator, e.g., by being wrapped around an accumulator spindle 16 of FIG. 1 or accumulator spindle 16" of FIG. 5. The coiled initiator is then inserted into initiator well 30 and slack detonating cord is withdrawn through threading port 58. The snug fit of the detonating cord within threading port 58 securely maintains the detonating cord in place. If the accumulator spindle 16" is used with the cast booster explosive charge 26', circular plate 17*b* will be seated against the bottom 30*a*' of initiator well 30.

The method of the present invention is readily utilized even in the field in adverse weather conditions and even when the operator is wearing gloves or mittens to protect his or her hands against cold weather. Inserting the end an LEDC to a slot of the accumulator and thereupon wrapping it around the accumulator and wedging it in place is easy to carry out even under adverse field conditions.

As indicated above, the practice of the present invention need not be restricted to low-energy detonating cord. Optionally, non-low-energy detonating cord could be formed into a coil as taught and claimed herein to form an initiator charge. In either case, a detonating cord could optionally be used in place of a conventional booster charge. For example, a detonating cord formed into a coil as taught herein could be used to replace a booster charge such as the charge 26' shown in FIG. 7. The coiled detonating cord would constitute an explosive charge which could then be used itself to directly initiate a bulk explosive charge, e.g., a column of borehole explosive such as ammonium nitrate/fuel oil (ANFO) or the like. Alternatively, a coiled detonating cord could be used directly for accomplishing certain results on non-explosive objects, e.g., it could be used for breaking rock.

While the invention has been described in detail with reference to particular embodiments thereof, numerous variations to the specific embodiments nonetheless lie within the scope of the present invention.

What is claimed is:

1. An explosive charge comprising a length of detonating cord disposed in a substantially helical coil comprising a plurality of windings disposed about a spindle comprising a cut-off barrier between adjacent windings.

2. The explosive charge of claim 1 comprising adjacent windings spaced from each other by not more than about 0.5 inch (or 12.7 mm).

3. The explosive charge of claim 2 wherein windings are spaced from each other by about 3.3 cm.

4. The explosive charge of claim 1 or claim 2 wherein the detonating cord has a core of explosive material with a loading of 12 grains or less per foot of the cord.

5. The explosive charge of claim 4 comprising from 2 to 4 windings.

6. The explosive charge of claim 4 wherein the detonating cord has a core of explosive material with a loading in the range of from 8 to 12 grains per foot of the cord.

7. The explosive charge of claim 1 wherein the spindle is configured to produce a helical coil of diminishing diameter that defines a taper angle of from about 2 to 4 degrees.

8. The explosive charge of claim 1 wherein the detonating cord is wound around an accumulator spindle comprising a spindle body that comprises the cut-off barrier and an anchor aperture.

9. The explosive charge of claim 8 wherein the spindle body is configured to produce a helical coil of diminishing diameter.

10. The explosive charge of claim 8 wherein the accumulator spindle is configured to produce a helical coil of diminishing diameter that defines a taper angle in the range of from about 2 to 4 degrees.

11. The explosive charge of claim 1 wherein the spindle is configured to produce a helical coil of diminishing diameter.

12. An explosive charge comprising a length of detonating cord disposed in a substantially helical coil comprising a plurality of windings and a cut-off barrier between adjacent windings, wherein the detonating cord is wound around an accumulator spindle comprising a spindle body that comprises the cut-off barrier and an anchor aperture; and wherein the accumulator spindle further comprises a cleat protection.

13. The explosive charge of claim 12 wherein the cut-off barrier defines a substantially helical groove, wherein the groove has two ends, and wherein the anchor aperture is at one end of the groove and the cleat projection is at the other end of the groove.

14. The explosive charge of claim 12 wherein the accumulator spindle is configured to produce a helical coil of diminishing diameter.

* * * * *